US005477595A

United States Patent [19]

Weingarten et al.

[11] Patent Number: 5,477,595

[45] Date of Patent: Dec. 26, 1995

[54] KNITTED FABRIC CONSTRUCTION FOR AN INDUSTRIALLY LAUNDERABLE SOFT HAND KNITTED GARMENT

[75] Inventors: Jon Weingarten, Weston; Rod Kosann, Stamford, both of Conn.; Jerry E. Wallace, Statesville; Olin E. Wilson, Wake Forest, both of N.C.; Maura T. Buckley, Glen Ridge, N.J.

[73] Assignee: Burlington Industries, Inc., Greensboro, N.C.

[21] Appl. No.: 305,957

[22] Filed: Sep. 12, 1994

Related U.S. Application Data

[63] Continuation-in-part of Ser. No. 195,141, Feb. 14, 1994.

[51] Int. Cl.[6] ..... A41B 1/00; D04B 1/14

[52] U.S. Cl. ..... 28/100; 66/202; 8/185; 8/532

[58] Field of Search ..... 57/256, 328, 224; 28/100; 8/185, 532; 66/202

[56] References Cited

U.S. PATENT DOCUMENTS

| | | | |
|---|---|---|---|
| 3,660,010 | 5/1972 | Georgoudis et al. | 8/185 X |
| 3,811,131 | 5/1974 | Camarra et al. | 8/185 X |
| 3,811,834 | 5/1974 | Schwemmer et al. | 8/185 X |
| 3,862,224 | 1/1975 | Peterson et al. | 8/185 X |
| 3,891,389 | 6/1975 | Verburg et al. | 8/185 X |
| 3,978,648 | 9/1976 | Yamagata et al. | 57/224 |
| 4,801,303 | 1/1989 | Carlough et al. | 8/532 |
| 5,050,406 | 9/1991 | Strauss et al. | 66/202 X |
| 5,077,126 | 12/1991 | Green | 57/256 X |
| 5,103,626 | 4/1992 | Morrison | 57/328 X |
| 5,243,813 | 9/1993 | Stahlecker | 57/328 |

*Primary Examiner*—John J. Calvert
*Attorney, Agent, or Firm*—Nixon & Vanderhye

[57] ABSTRACT

Fabric suitable for the manufacture of rental shirts that are capable of being industrially laundered are made by air jet spinning an intimate blend of about 50–50 polyester/cotton (having wrapper fibers holding the yarn bundle together), vat dyeing the cotton component of the yarn (and disperse dyeing the polyester component), and then knitting the dyed yarn to produce a fabric with tightly formed stitches. The yarn is also scoured and finished prior to knitting. The knit fabric is preferably made into a rental shirt or like garment, the fabric having a good shrinkage, a colorfast, pilling, and life expectancy properties, and a soft hand. At the end of scouring in a jet machine, cationic softener is added which chemically bonds with the fabric cotton fibers, to provide softer hand over the life of the fabric. The finish formula includes amphoteric and hydrophilic silicone softeners to also provide soft hand, and a sewing lubricant to reduce the possibility of needle cutting during the garment sewing process.

20 Claims, 2 Drawing Sheets

KNITTED FABRIC CONSTRUCTION FOR AN INDUSTRIALLY LAUNDERABLE SOFT HAND KNITTED GARMENT

CROSS-REFERENCE TO RELATED APPLICATION

This application is a continuation-in-part of application Ser. No. 08/195,141 filed Feb. 14, 1994.

BACKGROUND AND SUMMARY OF THE INVENTION

By far the most common product in the rental shirt industrial laundry market is a four and one-half oz. 65/35 polyester/cotton woven poplin work shirt. This product, in the early 1960s, replaced the 100% woven cotton garments that were the standard in the industry at that time. Attempts have been made to introduce other products into the industrial laundry retail shirt market in the 1980s, but they have either been completely or mostly unsuccessful. While a 80/20 polyester/cotton woven poplin fabric shirt is still being sold, it has poor comfort properties, and is not a significant factor in the market place. Also, attempts were made to market a plaited work shirt with a 100% polyester face and 50/50 polyester/cotton back. However this product was rejected by the industrial laundry rental circuit marketplace for several reasons, including because it was too hot for employees wearing the garment.

Knit shirts are also sold today by rental companies primarily through direct sale. The manufacturers of such shirts, however, do not recommend that the shirts be laundered commercially because of substantial color loss, surface abrasion, and shrinkage. Under industrial laundry conditions, such knit fabrics exhibit significant color loss, excessive shrinkage, abrasion, and pilling, and general breakdown in fabric appearance. Their life expectancy is only half of that of the standard 65/35 polyester/cotton woven poplin shirts, while being 15 to 25% more expensive.

According to the present invention, a knitted fabric has been developed, from which competitive knit garments can be produced which withstand industrial laundering, having a life that compares favorably to the standard 65/35 polyester/cotton woven poplin garment while having good comfort, porosity, and hand properties. The term "industrial laundering" as used in the specification and claims, and as commonly used in the industry, refers to both commercial and hospital industrial laundries, which utilize typical wash temperatures of 145°–165° F., and strong detergent/formulas, which include chlorine bleach, and highly alkaline chemicals. These conditions cause conventional knit fabrics to exhibit significant color loss, excessive shrinkage, excessive abrasion and pilling, and general breakdown in fabric appearance so that they have a life expectancy of much less than 50 industrial laundering wash-dry-wear cycles, making them commercially unacceptable.

According to the present invention a knit fabric suitable for making a work shirt for the rental shirt market that is capable of industrial laundering, having a life expectancy of at least 50 industrial laundering wash-dry-wear cycles, is provided. The two primary aspects of the present invention that result in a knitted product capable of industrial laundering while still having acceptable colorfastness, shrinkage, abrasion, pilling, and general fabric appearance qualities, are the use of air jet spun intimate polyester/cotton blend yarns (e.g. about a 50/50 polyester/cotton blend), and vat dyeing the air jet spun yarn with a vat dye, to impart colorfastness to the cotton component thereof: and dyeing the polyester component as well as with disperse dyes. Also important to obtaining a desired shrinkage resistance, as well as to impart other desirable features (such as soil release and wrinkle reduction features), are practicing the knitting to produce tightly formed stitches, scouring the knit fabric, and finishing the fabric.

According to the invention it is also possible to make a fabric, and a garment produced by the fabric, having a softer hand than the fabric/garment previously described. Soft hand is obtained by first adding a cationic softener to the scoured cloth while still in the jet machine that is used to scour the cloth, and then finishing the fabric in a pass (typically a single pass) using a formula that (in addition to imparting the soil release and wrinkle reduction features described above) assists in imparting soft hand and reduced possibility of needle cutting during the garment sewing process. The formula may include about 35–45% by weight of a glyoxal-based resin, about 15–25% by weight of amphoteric softener, about 3–10% by weight hydrophilic silicone softener, about 1–3% by weight sewing lubricant, about 3–10% by weight of a non-ionic fluorochemical stain release agent, with the remaining approximately 20–25% water.

According to one aspect of the present invention a method of producing a fabric suitable for use as a rental shirt capable of being industrially laundered is provided. The method comprises the steps of substantially sequentially: (a) Air jet spinning an air jet spun intimate polyester/cotton blend yarn, having wrapper fibers holding the yarn bundle together. (b) Vat dyeing the cotton component of the air .jet spun yarn with vat dye and, also dyeing the polyester component with disperse dyes. (c) Knitting the dyed yarn into a fabric suitable for use in the production of a rental shirt capable of being industrially laundered. (d) Scouring the knit fabric, and softening the fabric immediately after scouring; and (e) finishing the fabric to impart soil release, wrinkle reduction, soft hand, and shrinkage resistance properties to the fabric.

Step (c) is practiced to knit the fabric with tightly formed stitches. The designation "tightly formed stitches" in the knitting art has a specific meaning, although the meaning varies numerically depending upon the particular knitting construction utilized. Anything tighter than 35 stitches per inch on jersey fabrics and 38 stitches per inch on pique constructions is considered "tightly formed stitches". Other types of knitting have different numerical values.

The method steps (a) through (e) according to the present invention are practiced to produce a fabric which shrinks a maximum of about 8% both in length and width unrestored after five wash and tumble dry sequences per AATCC Test Method 135, has a colorfastness rating of 4.0 or higher when subjected to AATCC Test Method 61-IIA, has a rating of 4.0 or higher when tested for pilling using ASTMD3512 Resistance to Pilling, Random Tumble test method, a life expectancy of at least 50 industrial laundering wash-dry-wear cycles, and a softer hand than if steps (d) and (e) were not practiced.

Step (a) is typically practiced to produce a substantially 50—50 intimate polyester/cotton blend air jet spun yarn. Step (e) is typically practiced in a single pass using a finish formula containing a glyoxal-based resin, an amphoteric softener, an hydrophilic silicone softener, a sewing lubricant, and a non-ionic fluorochemical stain release agent. There is also typically the further step, between steps (a) and (b), of winding the undyed yarn onto a dye package. The dyes typically used to dye the cotton component are vat black 16, vat brown 1, vat green 1, vat green 3, vat red 13, vat yellow 2, or vat blue 55 dye. Step (b) is typically also further practiced using disperse dyes at the same time as vat dyeing takes place, or in a different dyeing process, the disperse dyes dyeing the polyester component of the intimate polyester/cotton blend air jet spun yarn.

The invention also relates to making a garment capable of being industrially laundered, with the knitted fabric produced by the steps set forth above (typically after scouring and finishing). The garment has a life expectancy of at least 50 industrial laundering wash-dry-wear cycles, and soft hand.

The invention also relates to a knit fabric and garment made therefrom. The knit fabric according to the invention is formed of air spun yarn knit with tightly formed stitches, and is capable of being industrially laundered. The garment shrinks a maximum of about 8% both in length and width unrestored after five wash and tumble dry sequences, has a colorfastness rating of 4.0 or higher when subjected to AATCC Test Method 61-IIA, has a rating of 4.0 or higher when tested for pilling using ASTMD3512 Resistance to Pilling, Random Tumble test method, a soft hand, and has a life expectancy of at least 50 industrial laundering wash-dry-wear cycles. The garment typically comprises a shirt, and the air jet spun yarn is typically an approximately 50–50 polyester-cotton intimate blend having a pique or a jersey knit construction.

It is the primary object of the present invention to produce a fabric for use in making a work shirt, or like garment, capable of being industrially laundered, yet having a knit construction, with good comfort, soft hand, colorfastness, and shrinkage resistance properties. This and other objects of the invention will become clear from an inspection of the detailed description of the invention and from the appended claims.

DETAILED DESCRIPTION OF THE DRAWINGS

Figure 1:
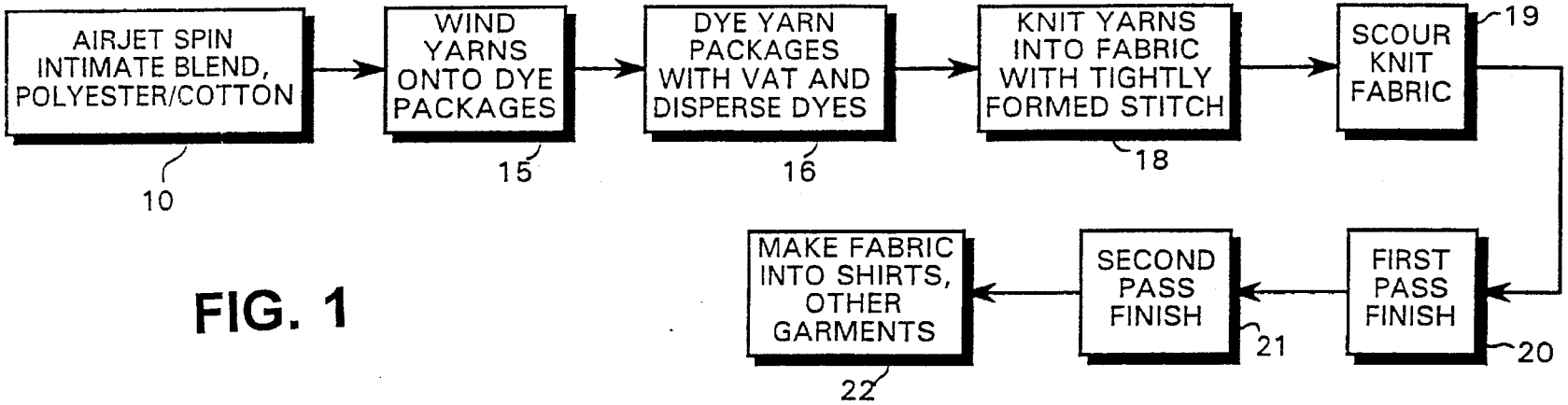
FIG. 1 is a box diagram of an exemplary method according to the present invention.
Figure 2:
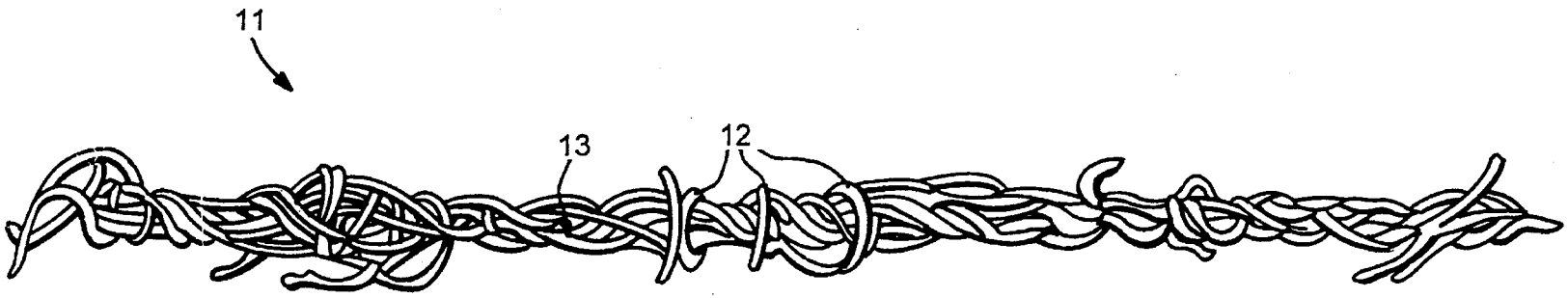
FIG. 2 is an enlarged schematic view showing an exemplary air jet spun yarn that is utilized in the practice of the present invention.

FIG. 1 schematically illustrates an exemplary method according to the present invention for producing a knitted fabric for making a work shirt, or like garment, capable of being industrially laundered and having acceptable comfort, porosity, and hand properties. The first step in the practice of the method of FIG. 1 is the air jet spinning of an intimate blend polyester/cotton yarn, and is indicated at box 10 in FIG. 1. Although other blends may be utilized, an approximately 50–50 polyester/cotton intimate blend is particularly desirable. An exemplary air jet spun yarn that is utilized according to the present invention is shown generally by reference numeral 11 in FIG. 2, the air jet spun yarn 11 being produced utilizing conventional air jet spinning equipment. The air jet spun yarn 11 has wrapper fibers 12 which hold the fibers of the main yarn bundle 13 together, allowing minimal fiber escape, and thus minimizing work-up and pilling compared to conventional ring spun or open end spun yarns. For example a 20-1 50/50 polyester/cotton intimate blend, may be provided.

After spinning, the yarn 11 is then wound onto dye packages, as indicated by step 15 in FIG. 1, and then the yarn packages are dyed with a mixture of vat and disperse dyes using conventional dyeing techniques, as indicated by box 16 in FIG. 1. Exemplary vat dyes that can be utilized are: vat black 16, vat brown 1, vat green 1, vat green 3, vat red 13, vat yellow 2, or vat blue 55 dye. Vat dyes are absorbed by cotton fibers when the dye molecules are in the soluble state. Upon chemical oxidation, the vat dyes are converted to their original water insoluble form, whereupon the dyes become insoluble color pigments imbedded within the cotton fibers, exhibiting superior wash fastness compared to other dyes. Advantages of vat dyes compared to other dyes are: (a) Excellent wash fastness, even when washing at a boil with alkali. (b) Improved cold water bleed. (c) Good fastness to heavy industrial laundry. (d) Good resistance to chlorine and peroxide bleaching. (e) Good light fastness. (f) Good resistance to perspiration; and (g) minimal shade change with resin finishing.

Disperse dyes are used at the same time to dye the polyester component of the blend yarn. An exemplary dye procedure for the polyester/cotton intimate blend yarn according to the invention is as follows: Load the yarn packages into a package dyeing machine. Add chemicals (disperse dyes for polyester and vat dyes for cotton). Adjust the liquid volume to high level. Heat to 120° F. and hold for five minutes. Heat to 160° F. at maximum rate. Heat to 190° at 20° F. per minute. Heat to 265° F. at 1° F. per minute and hold for 20 minutes. Cool to 170° at 3° F. per minute and hold for five minutes. Dose add caustic soda and sodium hydrosulfite. Heat to 170° at 3° F. per minute and hold for 20 minutes. Cool to 140° F. at 2° F. per minute and hold for 20 minutes. Dose add solid salt. Heat to 140° F. at 2° F. per minute and hold for 30 minutes. Cool to 120° F. at 2° F. per minute. Overflow rinse at 90° F. for 20 minutes. Fill the machine to a high level. Dose add chemicals. Heat to 90° F. and hold for 10 minutes. Heat to 140° F. at maximum rate and hold for 10 minutes. Drain the bath. Fill the machine to the high level. Heat to 195° F. at the maximum rate and hold for 10 minutes. Drain the bath. Overflow rinse at 100° F. for 10 minutes. Fill the machine to the high level. Heat to 120° F. at maximum rate and hold for five minutes. Drain the bath; and unload the yarn packages.

After dyeing, the yarn is knit into fabric with tightly formed stitches, as indicated by box 18 in FIG. 1. The term "tightly formed stitch" as used in the knitting art, and in this disclosure and claims, refers to anything tighter than 35 stitches per inch on jersey fabrics, and 38 stitches per inch on pique constructions. The definition of tightness for other knit constructions is different than for jersey or pique. For example an interlock knit construction is considered to have a tightly formed stitch at 32 to 34 stitches per inch. It is desirable for the knit construction to result in a finished fabric weight of 9 to 11 ounces per linear yard to produce the work shirts according to the present invention.

After knitting, the fabric is preferably subjected to a scouring step, as indicated schematically at 19 in FIG. 1. A typical scouring procedure, which is utilized to remove any residues left on the yarn after the dyeing and knitting steps, may be practiced as follows:

A jet machine is filled with water, and two grams per liter of a nonionic detergent (such as "Topscour FFJ" sold by Top Tex South, Inc. of Charlotte, N.C.) is added, and the fabric is loaded at 80° F. bath temperature. The bath is then heated to 140° F. at 3° F. per minute temperature rise, and the machine is run for 30 minutes at 140° F. Then the bath is drained, the jet machine is filled with cool water, and rinsed for 10 minutes. The scoured cloth is then unloaded.

After step 19, the fabric is passed to a finishing procedure. In one exemplary finishing procedure according to the present invention there is a first pass finish indicated schematically at 20 in FIG. 1, and then a second pass finish indicated schematically at 21 in FIG. 1. The first pass finish 20 may be made using only water while in the second pass finish, 21, a finish formula is utilized so as to provide soil release properties to the fabric to minimize staining from different types of soil, while at the same time reducing wrinkling during the washing and drying, improving shrinkage resistance, and providing softeners to give the final fabric produced a better hand while reducing the possibility of needle cutting during the garment sewing process, the exemplary formula that may be utilized is about 15–25% (e.g. about 18.0%) by weight of a glyoxal-based resin (such as Sedgefez 804 available from Sedgefield Specialties of Greensboro, N.C.), about 3–10% (e.g. about 6%) by weight of a polyethylene, slightly cationic softener (such as "Sedgesoft RPS", also available from Sedgefield), about 0.1–0.5% (e.g. about 0.2%) by weight of a non-ionic alcohol ethoxylate wetting agent (such as Sedgemul 91-6, also available from Sedgefield), and about 1–5% (e.g. about 3%) by weight of a non-ionic fluorochemical stain release agent (such Scotchgard FC-248, available from 3M Protective Chemical Products Division, St. Paul, Minn.). The remaining approximately 70–75% (e.g. about 72.8%) by weight of the formula is water.

Figure 3:
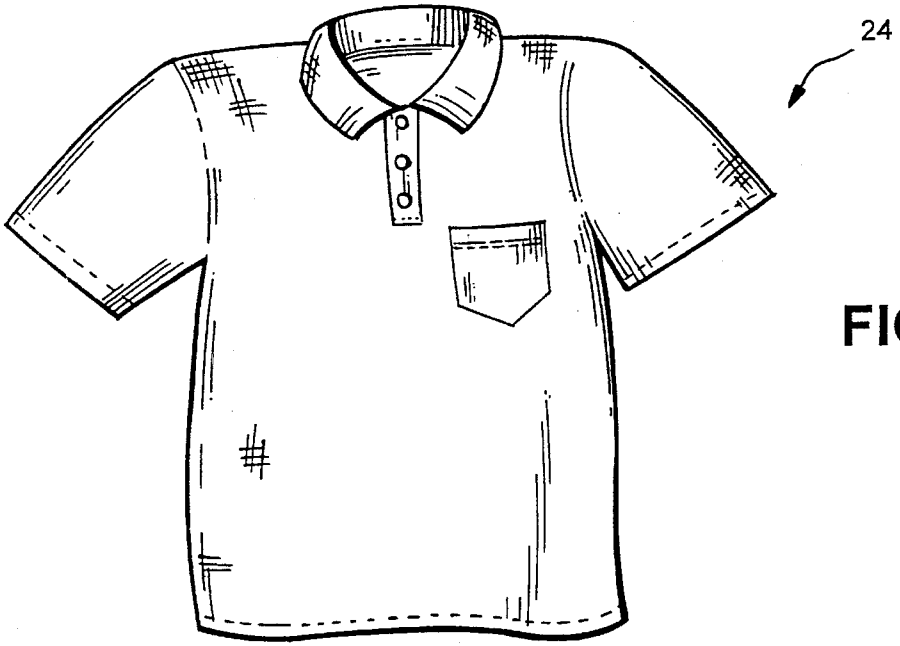
FIG. 3 is a perspective view of an exemplary work shirt produced frown the knitted fabric according to the present invention.

After finishing at stage 21, the fabric is made into work shirts and other garments, as indicated schematically at 22 in FIG. 1, utilizing conventional manual, automatic, or combined manual and automatic garment construction, cutting and sewing techniques. An exemplary work shirt produced from the fabric according to the present invention is illustrated schematically at 24 in FIG. 3.

The fabric produced according to steps 10, 15, 16, 18, 19, 20 and 21 of FIG. 1, and the garment 24 produced from the fabric, have minimal shrinkage (maximum shrinkage resistance), acceptable colorfastness, acceptable length, resistance to abrasion and pilling, and a life expectancy of at least 50 industrial laundering wash-dry-wear cycles. The fabric and garment 24 shrink a maximum of about 8% both in length and width unrestored after five wash and tumble dry sequences per AATCC Test Method 135, have a colorfast rating of 4.0 or higher when subjected to AATCC Test Method 61-IIA, and have a rating of 4.0 or higher when tested for pilling using ASTMD 3512 resistance to pilling, random tumble test method. The garment 24 has good comfort and hand properties, and is competitive with the 65/35 polyester/cotton woven poplin garments dominant in the industrial laundry rental shirt market.

Figure 4:
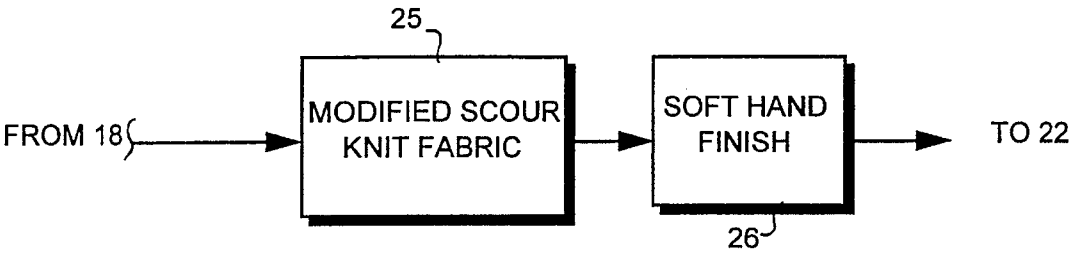
FIG. 4 is a partial view of the schematically illustrated process of FIG. 1 showing a modification to the scouring and finishing procedures.

FIG. 4 schematically illustrates a modified form of the method of FIG. 1 where a softer hand is required in the fabric and final garment to be produced. The method of FIG. 4 is the same as the method of FIG. 1 as tar as steps 10, 15, 16, 18, and 22 are concerned. However steps 19 through 21 are replaced with steps 25 and 26 schematically illustrated in FIG. 4.

The garments produced according to FIG. 1 are typically used as uniforms that feel relatively rough and exude firmness and toughness. They have a longer lasting good appearance after washing. However they do not drape as well and are more rigid than garments produced according to the method of FIG. 4. The garments produced by the method of FIG. 1 would typically be used, for example, in the fast food industry; while those produced according to the method of FIG. 4 would be used where a "softer" uniform look is desired (e.g. in casual style restaurants where waiters and waitresses serve tables, or even by members of the public for everyday garments). The garments produced by the method of FIG. 4 have better drape, more stretch, and softer hand.

It has been essentially impossible, to date, to quantify "hand". While a hand measurement device was developed by Kawabata of Japan, it has not been accepted by the textile industry. Hand determinations are subjective. Typically a fabric or garment is produced that a customer likes, and a sample of that fabric is then kept by the manufacturer, and all subsequent production is compared to it by experienced workers "feeling" with their hands the original sample and most recent production side-by-side. A fabric/garment has "softer hand" if the average person employed to compare fabric hands can readily perceive the difference by side-by-side comparison of the feel of two samples with his or her hands.

In the modified scour knit fabric stage 25, a jet machine is filled with water and about two grams per liter of a non-ionic detergent is added, and the fabric is loaded at 80° F. bath temperature. The bath is then heated to 140° F. at a 3° F. per minute temperature rise, and the jet machine is run for 30 minutes at 140° F. Then the bath is drained, and the jet machine is filled with cool water and rinsed for ten minutes. The scoured cloth is then softened in the jet machine with cationic softener, such as 2% "Ceranine HCA" on weight of fabric from Sandoz Chemicals Corporation, Charlotte, N.C., and the cloth is then unloaded. This softener forms a chemical bond with cotton fiber and is retained in a final garment produced through normal wear-wash-dry cycles [although there is some gradual loss over the life of a garment], which bond provides softer hand over the fabric's life.

After step 25, the fabric is passed to a finishing procedure. In one exemplary finishing procedure according to the present invention there is a single chemical finish pass indicated schematically at step 26 in FIG. 4. A finish formula is utilized so as to provide soil release properties to the fabric to minimize staining from different types of soil, while at the same time reducing wrinkling during the washing and drying, improving shrinkage resistance, and providing softeners to assist in giving the final fabric produced a softer hand while reducing the possibility of needle cutting during the garment sewing process. One exemplary formula that may be utilized is about 35–45% (e.g. about 39.0%) by weight of a glyoxal-based resin (such as Sedgefez 804 available from Sedgefield Specialties of Greensboro, N.C., about 15–25 % (e.g. about 20.0%) by weight of amphoteric softener (such as Lubesoft NLS from Consolidated Chemical Industries, Greensboro, N.C.), about 3–10% (e.g. about 6.0%) by weight hydrophilic silicone softener (such as Wake's ECP from Ivax Industries, Rock Hill, S.C.), about 1–3% (e.g. about 2.0%) by weight sewing lubricant (such as Sandolube NV from Sandoz Chemicals Corporation, Charlotte, N.C.), and about 3–10% e.g. about 6.0%) by weight of a non-ionic fluorochemical stain release agent such as Scotchgard FC-248. available from 3M Protective Chemical Products Division, St. Paul, Minn.). The remaining approximately 20–25% (e.g. about 23%) by weight of formula is water.

After finishing at 26 the fabric is made into work shirts and other garments, e.g. for waiters and waitresses in casual table-serve restaurants, as indicated schematically at 22 in FIG. 1 again using conventional techniques. The exemplary work shirt produced according to this aspect of the invention, which is the same as that illustrated by reference numeral 24 in FIG. 3, has the same characteristics as the garment described above with respect to FIG. 1 (that is minimal shrinkage, acceptable colorfastness, a life expectancy of at least 50 industrial laundering wash-dry-wear cycles, etc.) but has a much softer hand than the garment produced according to the FIG. 1 process (i.e. with different steps (d) and (e)).

It will thus be seen that according to the present invention an exemplary method of producing a knitted fabric, and of producing a knit garment from that fabric, are provided having numerous advantageous properties and features. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of producing a fabric, comprising the steps of substantially sequentially:

(a) air jet spinning an air jet spun intimate polyester/cotton blend yarn, having wrapper fibers holding the yarn bundle together;

(b) vat dyeing the cotton component of the air jet spun yarn with vat dye, and dyeing the polyester component;

(c) knitting the dyed yarn into a fabric with tightly formed stitches;

(d) scouring the knit fabric and softening the fabric immediately after scouring to remove any residues left on the yarn after the practice of steps (b) and (c); and (e) finishing the fabric to impart soil release, wrinkle reduction, and shrinkage resistance properties to the fabric.

2. A method as recited in claim 1 wherein steps (a) through (e) are practiced to produce a fabric with a finished fabric weight of 9 to 11 ounces per linear yard.

3. A method as recited in claim 1 wherein step (c) is further practiced to produce a pique or a jersey fabric construction.

4. A method as recited in claim 3 wherein step (a) is practiced to produce a substantially 50—50 intimate polyester/cotton blend air jet spun yarn.

5. A method as recited in claim 1 wherein step (e) is practiced in a pass using a finish formula containing a glyoxal-based resin, an amphoteric softener, an hydrophilic silicone softener, and a non-ionic fluorochemical stain release agent.

6. A method as recited in claim 5 wherein step (e) is practiced in a single pass using a finish containing about 15–25% by weight of amphoteric softener, and about 3–10% by weight hydrophilic silicone softener.

7. A method as recited in claim 1 comprising the further step of making a knit fabric into shirts, and wherein step (e) is practiced in a pass using a finish formula containing about 35–45% by weight of a glyoxal-based resin, about 15–25% by weight of amphoteric softener, about 3–10% by weight hydrophilic silicone softener, about 1–3% by weight sewing lubricant, and about 3–10% by weight of a non-ionic fluorochemical stain release agent.

8. A method as recited in claim 1 wherein step (d) is practiced utilizing a jet machine which is filled with water and non-ionic detergent, is heated, drained, filled with cool water, and rinsed; and then cationic softener is added to the fabric in the jet machine, the cationic softener forming a chemical bond with cotton fiber and remaining therewith through normal wash-wear-dry cycles, to provide softer hand over the life of the fabric.

9. A garment produced by the steps of substantially sequentially:

(a) air jet spinning an air jet spun intimate polyester/cotton blend yarn, having wrapper fibers holding the yarn bundle together;

(b) vat dyeing the cotton component of the air jet spun yarn with vat dye, and also dyeing the polyester component;

(c) knitting the dyed yarn into a fabric;

(d) scouring the knit fabric in a jet machine, and softening the fabric in the jet machine after scouring;

(e) finishing the fabric to impart soil release, wrinkle reduction, soft hand, and shrinkage resistance properties to the fabric; and (f) making the fabric into a garment having a life expectancy of at least 50 industrial laundering wash-dry-wear cycles.

10. A garment as recited in claim 9 produced by a method in which step (e) is practiced in a pass using a finish formula containing about 35–45% by weight of a glyoxal-based resin, about 15–25% by weight of amphoteric softener, about 3–10% by weight hydrophilic silicone softener, about 1–3% by weight sewing lubricant, about 3–10% by weight of a non-ionic fluorochemical stain release agent, and about 20–25 % water.

11. A garment as recited in claim 10 produced by a method in which step (d) is practiced by adding cationic softener to the fabric in the jet machine after scouring, the cationic softener forming a chemical bond with cotton fiber and remaining therewith through normal wash-wear-dry cycles, to provide softer hand over the life of the fabric.

12. A garment as recited in claim 9 having a weight of 9 to 11 ounces per linear yard.

13. A method of producing a fabric, comprising the steps of substantially sequentially:

(a) air jet spinning an air jet spun intimate polyester/cotton blend yarn, having wrapper fibers holding the yarn bundle together;

(b) vat dyeing the cotton component of the air jet spun yarn with vat dye, and dyeing the polyester component;

(c) knitting the dyed yarn into a fabric;

(d) scouring the knit fabric and softening the fabric immediately after scouring; and (e) finishing the fabric, to impart soil release, wrinkle reduction, soft hand, and shrinkage resistance properties to the fabric, in a single pass using a finished formula containing a glyoxal-based resin, an amphoteric softener, an hydrophilic silicone softener, and a non-ionic fluorochemical stain release agent, containing about 15–25% by weight of amphoteric softener, and about 3–10% by weight hydrophilic silicone softener.

14. A method as recited in claim 13 wherein step (e) is further practiced by using a finish formula containing about 1–3% by weight sewing lubricant so as to reduce the possibility of needle cutting during manufacture of the fabric into garments.

15. A method as recited in claim 14 comprising the further step of forming the finished fabric into garments.

16. A method as recited in claim 15 wherein step (c) is practiced to knit the fabric with tightly formed stitches, and wherein steps (a)–(e) are practiced to produce a fabric which shrinks a maximum of about 8% both in length and width unrestored after 5 wash and tumble dry sequences per AATCC Test Method 135, has a colorfastness rating of 4.0 or higher when subjected to AATCC Test Method 61-IIA, has a rating of 4.0 or higher when tested for pilling using ASTMD3512 Resistance to Pilling, Random Tumble test method, a life expectancy of at least 50 industrial laundering wash-dry-wear cycles, and a softer hand than if steps (d) and (e) were not practiced.

17. A method as recited in claim 16 wherein steps (a) through (e) are practiced to produce a fabric with a finished fabric weight of 9 to 11 ounces per linear yard.

18. A method of producing a fabric, comprising the steps of substantially sequentially:

(a) air jet spinning an air jet spun intimate polyester/cotton blend yarn, having wrapper fibers holding the yarn bundle together;

(b) vat dyeing the cotton component of the air jet spun yarn with vat dye, and dyeing the polyester component;

(c) knitting the dyed yarn into a fabric;

(d) scouring the knit fabric and softening the fabric immediately after scouring;

(e) finishing the fabric to impart soil release, wrinkle reduction, soft hand, and shrinkage resistance properties to the fabric; and (f) making a knit fabric into shirts; and wherein step (e) is practiced in a pass using a finish formula containing about 35–45% by weight of a glyoxal-based resin, about 15–25% by weight of amphoteric softener, about 3–10% by weight hydrophilic silicone softener, about 1– 3% by weight sewing lubricant, and about 3∝10% by weight of a non-ionic fluorochemical stain release agent.

19. A method of producing a fabric, comprising the steps of substantially sequentially:

(a) air jet spinning an air jet spun intimate polyester/cotton blend yarn, having wrapper fibers holding the yarn bundle together;

(b) vat dyeing the cotton component of the air jet spun yarn with vat dye, and dyeing the polyester component;

(c) knitting the dyed yarn into a fabric;

(d) scouring the knit fabric and softening the fabric immediately after scouring; and (e) finishing the fabric to impart soil release, wrinkle reduction, soft hand, and shrinkage resistance properties to the fabric; and wherein step (d) is practiced utilizing a jet machine which is filled with water and non-ionic detergent, is heated, drained, filled with cool water, and rinsed; and then cationic softener is added to the fabric in the jet machine, the cationic softener forming a chemical bond with cotton fiber and remaining therewith through normal wash-wear-dry cycles, to provide softer hand over the life of the fabric.

20. A method as recited in claim 19 comprising the further step of making a knit fabric into shirts, and wherein step (e) is practiced in a pass using a finish formula containing about 35–45% by weight of a glyoxal-based resin, about 15–25% by weight of amphoteric softener, about 3–10% by weight hydrophilic silicone softener, about 1–3% by weight sewing lubricant, and about 3–10% by weight of a non-ionic fluorochemical stain release agent.

* * * * *